US007811115B1

(12) United States Patent
Tyler

(10) Patent No.: US 7,811,115 B1
(45) Date of Patent: Oct. 12, 2010

(54) CONNECTOR ASSEMBLY WITH TWO STAGE LATCH

(75) Inventor: Adam Price Tyler, Rochester Hills, MI (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/539,261

(22) Filed: Aug. 11, 2009

Related U.S. Application Data

(60) Provisional application No. 61/201,605, filed on Dec. 12, 2008.

(51) Int. Cl.
*H01R 13/627* (2006.01)

(52) U.S. Cl. ..... 439/352

(58) Field of Classification Search ..... 439/352, 439/483, 350, 351, 108, 88, 181, 188
See application file for complete search history.

(56) References Cited

U.S. PATENT DOCUMENTS

| | | | | |
|---|---|---|---|---|
| 3,218,413 | A | 11/1965 | Poehlman, Jr. | |
| 3,320,383 | A | 5/1967 | Koetter | |
| 3,924,914 | A | 12/1975 | Banner | |
| 4,178,061 | A | 12/1979 | Ahroni | |
| 4,408,822 | A | 10/1983 | Nikitas | |
| 4,426,127 | A | 1/1984 | Kubota | |
| 4,575,704 | A | 3/1986 | Pezold | |
| 5,137,473 | A | 8/1992 | Nickola | |
| 6,095,843 | A * | 8/2000 | Kaneko et al. | 439/352 |
| 6,537,098 | B2 * | 3/2003 | Kashiyama et al. | 439/352 |
| 7,297,013 | B2 * | 11/2007 | Caveney et al. | 439/352 |
| 7,534,128 | B2 * | 5/2009 | Caveney et al. | 439/480 |
| 2003/0001715 | A1 | 1/2003 | Montague | |

FOREIGN PATENT DOCUMENTS

| | | |
|---|---|---|
| DE | 19727453 | 1/1999 |
| DE | 10 2007 010 515 | 9/2008 |
| EP | 1 427 067 | 6/2004 |
| GB | 2284510 | 6/1995 |
| GB | 2 359 939 | 9/2001 |

OTHER PUBLICATIONS

International Search Report, International Application No. PCT US/2009/006521, International Filing Date Nov. 12, 2009.

* cited by examiner

*Primary Examiner*—Chandrika Prasad

(57) ABSTRACT

A connector assembly includes an outer housing and a floating latch. The outer housing includes a flexible latch and mates with a header connector subassembly. The floating latch is slidably joined to the outer housing. The floating latch latches onto the outer housing and the header connector subassembly. When the outer housing is moved along a mating direction to mate with the header assembly, the floating latch travels with the outer housing until one of opposite ends of the floating latch couples to the header connector subassembly. After the floating latch is coupled to the header connector subassembly, the outer housing continues to travel along the mating direction relative to the floating latch with the floating latch sliding relative to the outer housing until another one of the opposite ends couples with the flexible latch of the outer housing.

20 Claims, 13 Drawing Sheets

CONNECTOR ASSEMBLY WITH TWO STAGE LATCH

CROSS-REFERENCE TO RELATED APPLICATIONS

This application relates to and claims priority benefit to U.S. Provisional Application No. 61/201,605, filed Dec. 12, 2008, and entitled "Connector Assembly With Two Stage Latch" (the "'605 Application"). The entire disclosure of the '605 Application is incorporated by reference herein in its entirety.

BACKGROUND OF THE INVENTION

The present invention relates to a connector assembly, and more particularly, to a connector assembly having mating subassemblies with latches to secure the subassemblies to one another.

Increased fuel costs and increased efforts at reducing environmental pollution have lead the automotive industry towards electric and hybrid electric vehicles (HEV). One design aspect of these vehicles is the consideration for the high operating voltage. Consequently, specific components of the vehicles must be designed to accommodate the high voltage. The electrical systems of these vehicles include components that operate at high voltages and require high voltage pathways including connectors. For example, some known electrical vehicular systems include components that operate using up to 600 volts.

In connector applications that use high voltage, special requirements exist for providing safety to users and to prevent damage to other system components and the connectors themselves. For example, if a connector is unmated under active high voltage power, at the instant the mating conductors of the high voltage connector disconnect, the high voltage power may cause severe damage to the connector. Consequently, in some applications, a high-voltage interlock (HVIL) circuit is used to protect the connectors and other system components from damage due to the high voltage power. An HVIL circuit controls the high voltage power so that the high voltage power is not active at the mating and unmating of the high voltage conductors. In an HVIL circuit, the sequence of mating and unmating the high voltage conductors and the mating and unmating of the HVIL contacts is controlled to prevent injury to users or damage to the components. For example, an HVIL circuit may ensure that the high voltage conductors are mated prior to the HVIL contacts and thus prior to activating the high voltage power and, the HVIL contacts are unmated, which deactivates the high voltage power, prior to (and after a preferred delay) the unmating of the high voltage conductors.

Connectors used in these applications, must provide a stable, sealed mechanical and electrical connection between a high voltage connector and a metallic module, the proper shunted HVIL, shielding continuity from the connector to the metallic housing and must provide a touch safe condition when the connectors are unmated. One problem is that the integration of an HVIL protection circuit with a high voltage connector usually requires a second connector or does not provide significant delay during the unmating sequence.

BRIEF DESCRIPTION OF THE INVENTION

In one embodiment, a connector assembly is provided. The connector assembly may be a plug connector assembly, or a non-plug connector assembly, such as a receptacle connector assembly. The connector assembly includes an outer housing and a floating latch. The outer housing extends from a mating end to a termination end. The outer housing includes a flexible latch disposed between the mating end and the termination end. The mating end is configured to mate with a header connector subassembly. The floating latch is slidably joined to the outer housing between the flexible latch and the mating end of the outer housing. The floating latch extends between opposite ends that are configured to latch onto the outer housing and the header connector subassembly. When the outer housing is moved along a mating direction to mate with the header assembly, the floating latch travels with the outer housing until one of the opposite ends of the floating latch couples to the header connector subassembly. After the floating latch is coupled to the header connector subassembly, the outer housing continues to travel along the mating direction relative to the floating latch with the floating latch sliding relative to the outer housing until another one of the opposite ends couples with the flexible latch of the outer housing.

In another embodiment, another connector assembly is provided. The connector assembly may be a plug connector assembly, or a non-plug connector assembly, such as a receptacle connector assembly. The connector assembly includes an outer housing, a cable terminal, a shorting bar and a floating latch. The outer housing is configured to mate with a header connector subassembly along a mating direction. The cable terminal is disposed in the outer housing and configured to mate with a conductor terminal of the header connector subassembly to transfer an electric current therebetween. The shorting bar is disposed in the outer housing and is configured to mate with an interlock terminal of the header connector subassembly to close an interlock circuit that controls transfer of the electric current. The floating latch is joined to the outer housing and is configured to latch onto each of the outer housing and the header connector subassembly to secure the outer housing to the header connector subassembly. The floating latch engages the header connector subassembly to secure the cable terminal with the conductor terminal prior to the floating latch engaging the outer housing to secure the shorting bar with the interlock terminal.

DETAILED DESCRIPTION OF THE INVENTION

Figure 1:
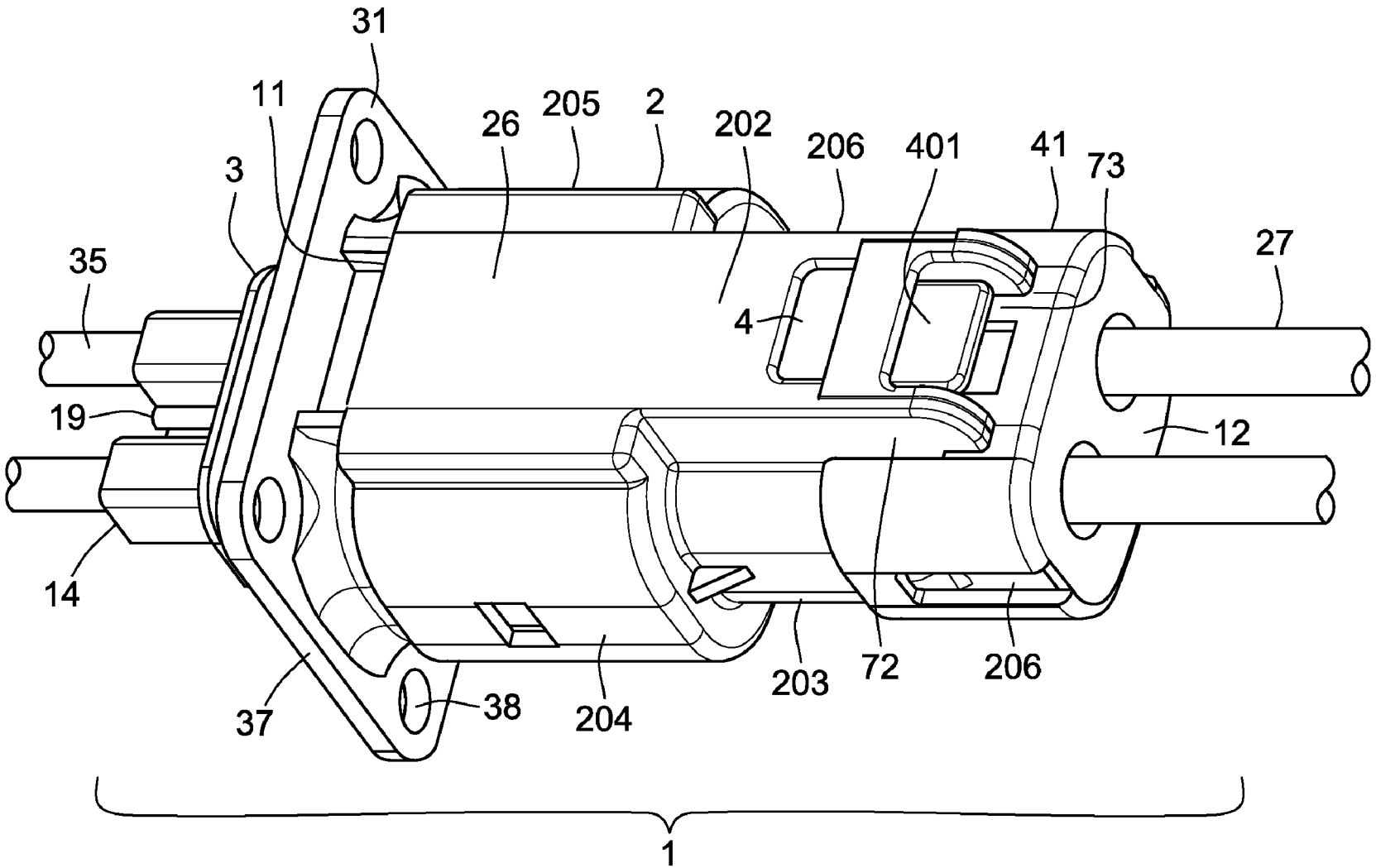
FIG. 1 is a perspective view of a mated connector assembly in accordance with one embodiment of the present disclosure.
Figure 3:
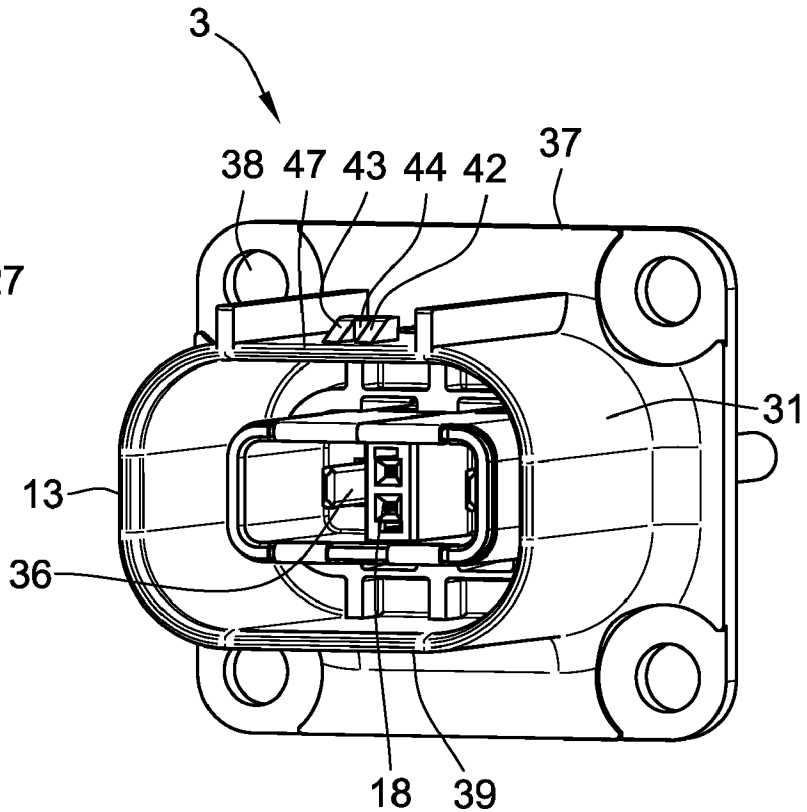
FIG. 3 is a perspective view of a header connector subassembly shown in FIG. 1 in accordance with one embodiment of the present disclosure.
Figure 2:
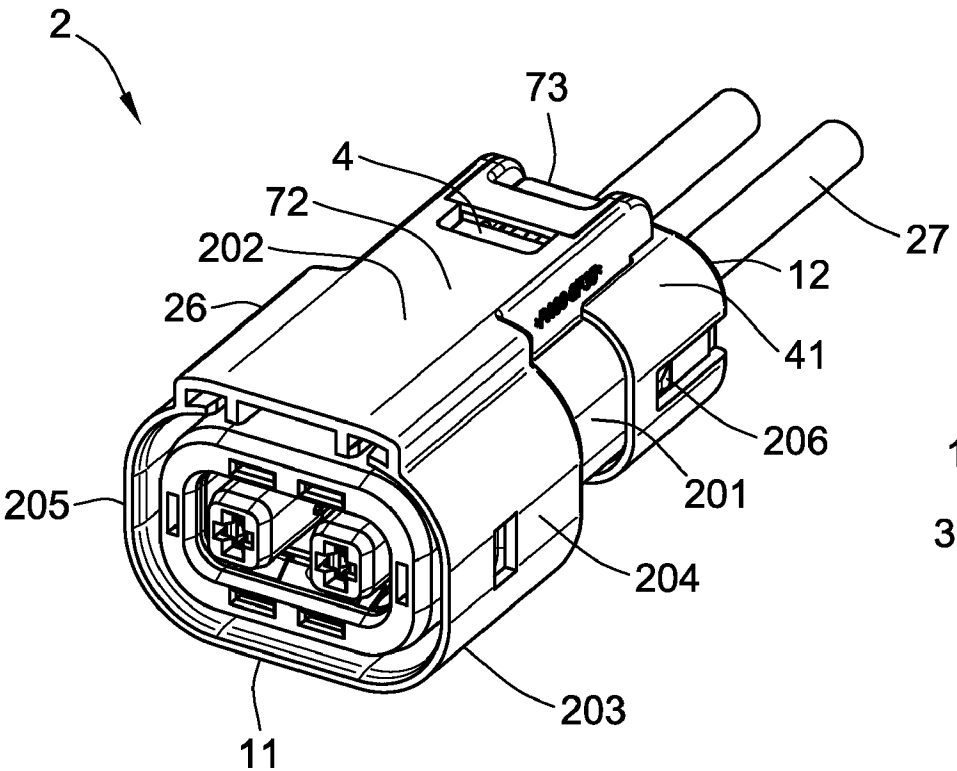
FIG. 2 is a perspective view of a plug connector subassembly shown in FIG. 1 in accordance with one embodiment of the present disclosure.

FIG. 1 is a perspective view of a mated connector assembly 1 in accordance with one embodiment of the present disclosure. FIG. 2 is a perspective view of a plug connector subassembly 2 in accordance with one embodiment of the present disclosure. FIG. 3 is a perspective view of a header connector subassembly 3 in accordance with one embodiment of the present disclosure. The connector assembly 1 is a high voltage connector assembly in one embodiment. For example, the connector assembly 1 may be capable of transferring electric current at a voltage up to approximately 600 volts. The connector assembly 1 may transfer current at voltages of at least approximately 42 volts. Alternatively, the connector assembly 1 may be an assembly that transfers electric current at a lesser voltage. The connector assembly 1 may be a vehicular connector assembly. For example, the connector assembly 1 may be used to transfer electric current between two or more electronic devices or modules in an automobile.

The connector assembly 1 includes the plug connector subassembly 2 and the header connector subassembly 3. The header connector subassembly 3 may be mounted to a module such as a metallic module (not shown) in an automotive high voltage application. By way of example only, the header connector subassembly 3 may be mounted to an exterior surface of a power distribution module of an automobile that serves as a power source to one or more electronic devices, such as air conditioning or heating units. The plug connector subassembly 2 includes a plug outer housing 26 has a generally cylindrical body 201 having a top 202, a bottom 203 and two sides 204, 205. The plug outer housing 26 extends from a mating end 11 to a termination end 12. The mating end 11 mates to the header connector subassembly 3 and one or more cables 27 are terminated to the plug connector subassembly 2 through or at the termination end 12. The cables 27 may be shielded cables, such as high voltage shielded cables. A latch cover 72 extends over the top 202 of the plug outer housing 26. The latch cover 72 has an opening 73 at the termination end 12. For example, the opening 73 may face toward the termination end 12 of the plug outer housing 26. Although not visible in the view shown in FIG. 2, a flexible latch 401 is coupled to the plug outer housing 26 between the mating end 11 and the termination end 12. In the illustrated embodiment, the flexible latch 401 is disposed in a position that is proximate to the latch cover 72. In one embodiment, the flexible latch 401 is fixed to the plug outer housing 26. One or more retention features 206 are located on the outer surfaces of the sides 204, 205 to lock a cable seal retainer 41 to the plug connector subassembly 2. The cable seal retainer 41 seals the termination end 12 of the plug outer housing 26. A floating latch 4 is disposed within the latch cover 72. For example, the floating latch 4 may be located underneath the latch cover 72. The floating latch 4 is slidably joined with the plug outer housing 26 such that the floating latch 4 may longitudinally slide relative to the plug outer housing 26 while remaining coupled with the plug outer housing 26. The flexible latch 401 is disposed rearward of the floating latch 4 in the illustrated embodiment.

The header connector subassembly 3 includes a header outer housing 31, a mating end 13 (shown in FIG. 3) and a mounting end 14 (shown in FIG. 1). The mating end 13 mates to the plug connector subassembly 2 and the mounting end 14 is mounted or otherwise coupled with a module (not shown), such as a power distribution module. In the illustrated embodiment, the header outer housing 31 includes a generally planar mounting section 37 having several through holes 38 for attaching the header connector to a module (not shown) and a generally cylindrical body section 39 (shown in FIG. 3) extending through the mounting section 37. The body section further includes a top surface 47 (shown in FIG. 3) having a protrusion 42 (shown in FIG. 3) extending from the top surface 47. The protrusion 42 comprises a ramp surface 43 (shown in FIG. 3) facing toward the mating end 13 of the header outer housing 31 and a stop surface 44 (shown in FIG. 3) facing toward the mounting end 14 of the header outer housing 31. As will be further described below, the protrusion 42 coordinates with and locks the floating latch 4 of the plug connector subassembly 2 to the header connector subassembly 3.

One or more conductors 35 (shown in FIG. 1) extend into the header connector subassembly 3 includes one or more conductors 35 to associated conductor terminals 36 (shown in FIG. 3). The conductor terminals 36 mate with corresponding cable terminals 28 (shown in FIG. 4) of the plug connector subassembly 2 to electrically couple the plug connector subassembly 2 and the header connector subassembly 3. The header connector subassembly 3 also includes interlock terminals 18 and associated interlock conductors 19. The interlock terminals 18 mate with a shorting bar 23 (shown in FIG. 4) of the plug connector subassembly 2 to electrically couple the plug connector subassembly 2 with the header connector subassembly 3. As described below, the conductor terminals 36 of the header connector subassembly 3 mate with the cable terminals 28 of the plug connector subassembly 2 to transfer electric power or current therebetween. In one embodiment, the connector assembly 1 transfers high voltage current between the conductor terminals 36 and the cable terminals 28. The cable terminals 28 alternatively may be referred to as high voltage terminals and the circuit that is closed when the cable terminals 28 and conductor terminals 36 mate may be referred to as a high voltage supply circuit.

The shorting bar 23 of the plug connector subassembly 2 closes an interlock circuit that is otherwise open between the interlock terminals 18 of the header connector subassembly 3. The closing of the interlock circuit may cause the device or power distribution module to which the header connector subassembly 3 is mounted to begin transferring the electric power or current through the conductor terminals 36 of the header connector subassembly 3 to the cable terminals 28 of the plug connector subassembly 2. Conversely, the opening of the interlock circuit may cause the device or power distribution module to which the header connector subassembly 3 is mounted to cease transferring the electric power or current through the conductor terminals 36 of the header connector subassembly 3 to the cable terminals 28 of the plug connector subassembly 2.

Figure 4:
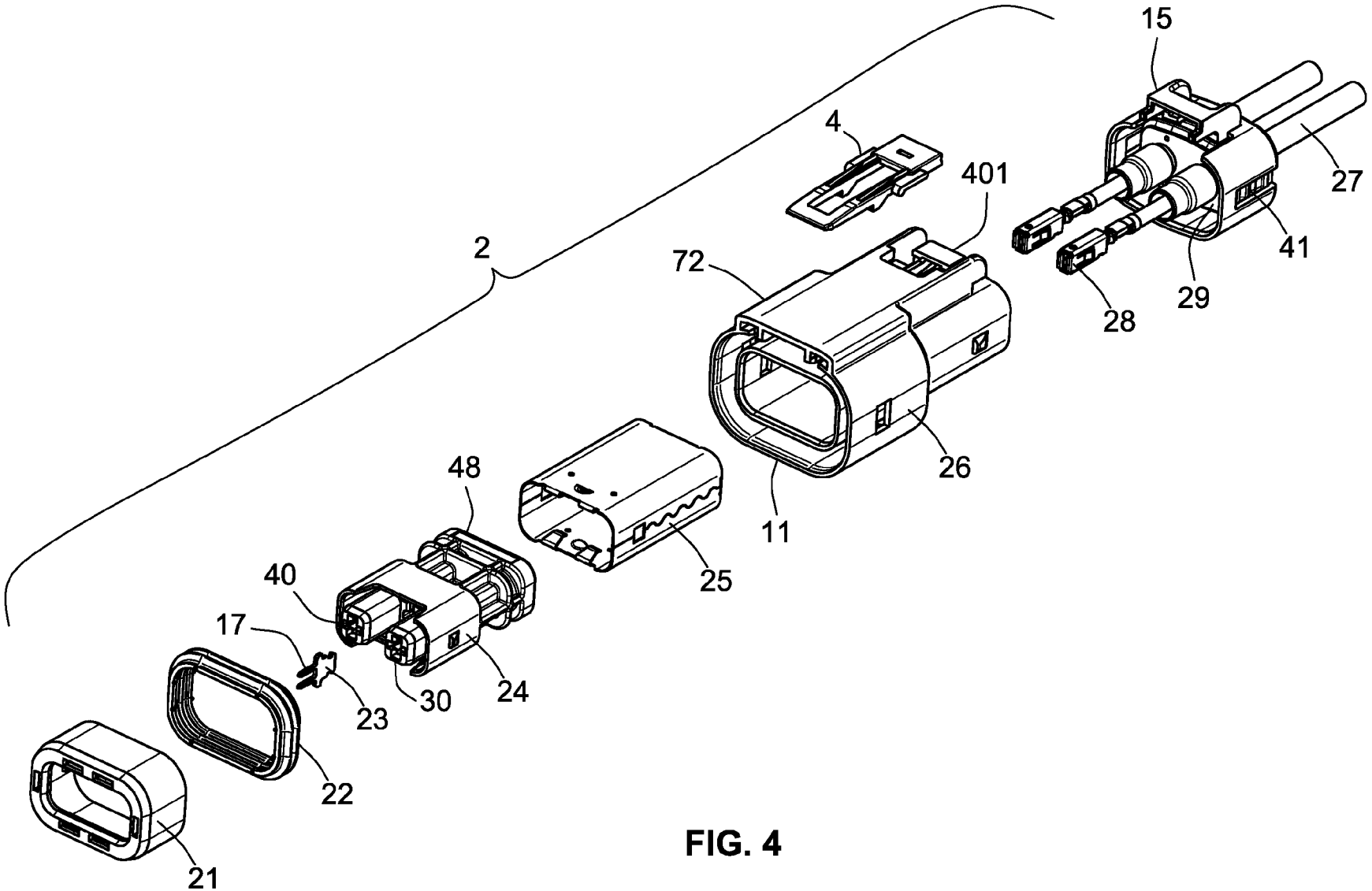
FIG. 4 is an exploded view of the plug connector subassembly in accordance with one embodiment of the present disclosure.

FIG. 4 is an exploded view of the plug connector subassembly 2 in accordance with one embodiment of the present disclosure. The plug connector subassembly 2 includes a peripheral seal retainer 21 and a peripheral seal 22. The peripheral seal retainer 21 extends around an outer perimeter of the mating end 11 of the plug outer housing 26 of the plug connector subassembly 2. In one embodiment, the peripheral seal 22 includes an elastomeric body that is shaped to extend around the outer perimeter of the mating end 11. The peripheral seal 22 is disposed between the peripheral seal retainer 21 and the mating end 11 of the plug outer housing 26. The peripheral seal retainer 21 is coupled to the plug outer housing 26 to secure the peripheral seal 22 between the peripheral seal retainer 21 and the mating end 11. The peripheral seal 22 may prevent ingress of moisture and other contaminants into the interior of the plug outer housing 26 through the mating end 11 once the plug connector subassembly 2 mates with the header connector subassembly 3 (shown in FIG. 1).

The plug connector subassembly 2 includes a plug inner housing 24 that is disposed within a plug shield 25, which is, in turn, disposed within the plug outer housing 26. In the illustrated embodiment, plug inner housing 24 is elongated from a front end 40 to a back end 48 and includes channels 30 that extend through the plug inner housing 24 between the ends 40, 48. The plug shield 25 may be an electromagnetic shield that includes, or is formed from, a conductive material. The plug shield 25 may be electrically joined with an electric ground reference via the cables 27 and/or the header connector subassembly 3 (shown in FIG. 1) when the plug connector subassembly 2 mates with the header connector subassembly 3. The plug shield 25 shields electronic devices disposed outside of the plug shield 25 from electromagnetic interference and/or electric fields generated by electric current running through the plug shield 25.

The plug inner housing 24 holds a shorting bar 23 at or proximate to the front end 40 of the plug inner housing 24. The shorting bar 23 may be a generally planar conductive body that includes, or is formed from, a conductive material. For example, the shorting bar 23 may be a conductive contact that is held in the plug inner housing 24. The shorting bar 23 includes extensions 17 that mate with the interlock terminals 18 (shown in FIG. 3) of the header connector subassembly 3 (shown in FIG. 3) when the plug connector subassembly 2 and the header connector subassembly 3 mate with one another.

Cable terminals 28 are joined with the cables 27. The cable terminals 28 provide a mating interface for the cables 27. For example, the cable terminals 28 may mate with the conductor terminals 36 (shown in FIG. 3) of the header connector subassembly 3 (shown in FIG. 3) to electrically couple the cables 27 with the header connector subassembly 3. The cable terminals 28 may include, or be formed from, a conductive material. The cable terminals 28 extend through the channels 30 in the plug inner housing 24 and may be accessible through the front end 40 of the plug inner housing 24. Alternatively, the cable terminals 28 may extend to, but not beyond, the front end 40 or may be recessed into the channels 30.

A cable seal 29 is disposed between the cable seal retainer 41. The cable seal 29 may be an elastomeric body that prevents ingress of moisture or other contaminants into the plug outer housing 26 through an interface between the plug outer housing 26 and the cable seal retainer 41. The cable seal retainer 41 comprises an actuation cover 15 that extends from the top of the cable seal retainer 41 to fit into the latching cover 72 of the plug outer housing 26. The actuation cover 15 partially encloses but provides access to the floating latch 4. The access provided to the floating latch 4 permits an operator or user to depress a portion of the floating latch 4 to disengage the floating latch 4 from at least one of the header connector subassembly 3 and the flexible latch 401.

Figure 6:
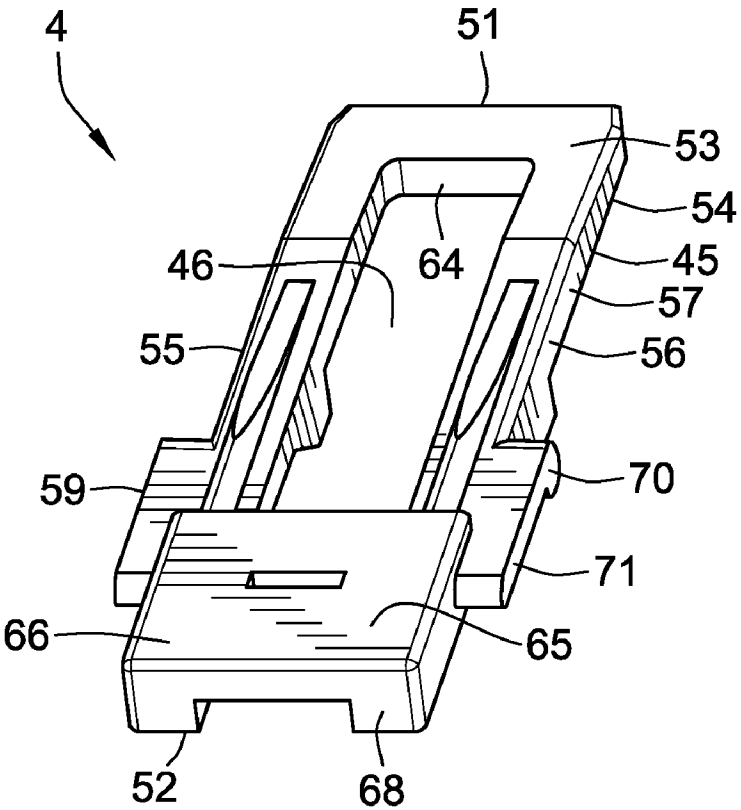
FIGS. 5 and 6 are perspective views of a floating latch shown in FIG. 1 in accordance with one embodiment of the present disclosure.
Figure 5:
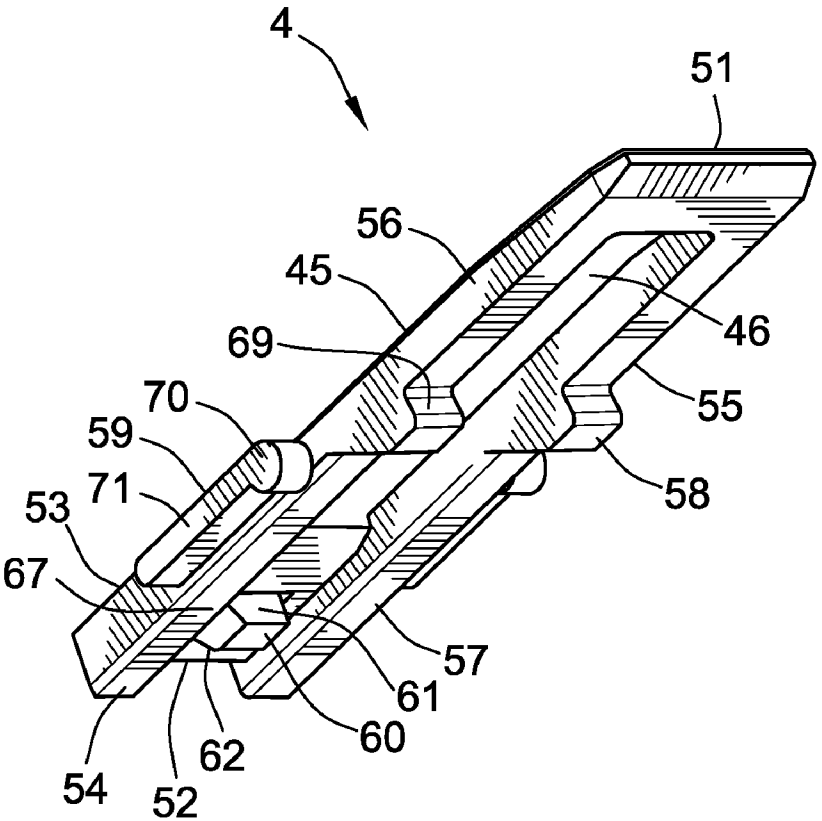

FIGS. 5 and 6 are perspective views of the floating latch 4 in accordance with one embodiment of the present disclosure. In the illustrated embodiment, the floating latch 4 comprises a generally rectangular body 45 having a mating end 51 and a latching end 52. The mating end 51 and latching end 52 are opposite one another and the body 45 extends from the mating end 51 to the latching end 52. The body 45 includes a generally rectangular cutout 46 located between the mating end 51 and the latching end 52. The floating latch 4 includes a top 53 and a bottom 54 that are interconnected by opposite sides 55, 56. The cutout 46 extends through the body 45 from the top 53 to the bottom 54. Rails 57 longitudinally extend from the bottom 54 and along the sides 55, 56. In the illustrated embodiment, the rails 57 are approximately parallel to one another and extend from the mating end 51 to the latching end 52. The rails 57 include bottom surfaces 67 and back surfaces 68 at the latching end 52.

Two stops 58 are coupled with or protrude from the rails 57 between the mating end 51 and the latching end 52. The stops 58 extend from the bottom 54 of the body 45 and are disposed approximately midway between the mating end 51 and the latching end 52 on either side of the cutout 46 in the illustrated embodiment. The stops 58 include stop mating surfaces 69 (shown in FIG. 5) that interact with the header outer housing 31 (shown in FIG. 1) to stop continued movement of the floating latch 4 with respect to the header outer housing 31 when the plug connector subassembly 2 mates with the header outer housing 31. For example, the floating latch 4 may be slidably coupled with the plug outer housing 26 (shown in FIG. 1) such that the floating latch 4 is joined with the plug outer housing 26 but is capable of longitudinally sliding relative to the plug outer housing 26. The floating latch 4 may move with the plug outer housing 26 when the plug outer housing 26 mates with the header outer housing 31 until the stops 58 engage the header outer housing 31. Continued movement of the plug connector subassembly 2 into the header outer housing 31 forces the floating latch 4 to rearwardly slide with respect to the plug outer housing 26 (shown in FIG. 1) and until the floating latch 4 engages and latches onto the flexible latch 401 (shown in FIG. 1) of the plug outer housing 26.

Lugs 59 longitudinally extend along the outer surfaces of the sides 55, 56 of the body 45. The lugs 59 include rounded pivot ends 70 and beam sections 71. The pivot ends 70 provide pivotal movement of the floating latch 4 with respect to the plug outer housing 26 (shown in FIG. 1). For example, the pivot ends 70 may abut or otherwise engage the plug outer housing 26 to permit the floating latch 4 to pivot about the pivot ends 70 when the plug connector subassembly 2 (shown in FIG. 1) transitions from a Stage 0 position to a Stage 1 position during mating of the plug connector subassembly 2 with the header connector subassembly 3 (shown in FIG. 1). The beam sections 71 permit sliding movement of the floating latch 4 with respect to the plug outer housing 26 when the plug connector subassembly 2 transitions from the Stage 0 position and the Stage 1 position. As described below, in the Stage 0 position, the plug connector subassembly 2 and the header connector subassembly 3 are unmated with one another. In the Stage 1 position, plug connector subassembly 2 is at least partially mated with the header connector subassembly 3 with the mating end 51 of the floating latch 4 engaged with and latched onto the protrusion 42 (shown in FIG. 3) of the header connector subassembly 3. The lugs 59 also may provide a retention surface to secure the floating latch 4 to the plug outer housing 26 when the plug connector subassembly 2 is in the Stage 1 position.

A locking tab 60 (shown in FIG. 5) extends from the bottom 54 of the floating latch 4 in a position that is at, proximate to, or adjacent to the latching end 52. The locking tab 60 includes a locking surface 61 and a ramped surface 62. The locking surface 61 and ramped surface 62 intersect one another in the illustrated embodiment. During mating of the plug connector subassembly 2 (shown in FIG. 1) with the header connector subassembly 3 (shown in FIG. 1), the ramped surface 62 slides along the flexible latch 401 (shown in FIG. 1) and biases the floating latch 4 away from the flexible latch 401. The locking tab 60 continues to slide along the flexible latch 401 until the locking surface 61 passes the flexible latch 401 and snaps downward to engage the flexible latch 401. The engagement between the locking tab 60 and the flexible latch 401 secures the floating latch 4 to the flexible latch 401.

The floating latch 4 further includes a latching surface 64 at the mating end 51 of the cutout 46. The latching surface 64 engages the protrusion 42 (shown in FIG. 3) of the header connector subassembly 3 (shown in FIG. 1) to secure the plug connector subassembly 2 (shown in FIG. 1) to the header connector subassembly 3 when the plug connector subassembly 2 and the header connector subassembly 3 mate with one another.

A tool actuation block 65 (shown in FIG. 6) is disposed at or proximate to the latching end 52 of the body 45. The tool actuation block 65 includes a tool actuation surface 66 (shown in FIG. 6) on the top 53 of the body 45 adjacent to the latching end 52. A tool such as a screwdriver or other device may be used to actuate the tool actuation block 65 to release the floating latch 4 and/or the flexible latch 401. For example, a screwdriver may engage and depress the tool actuation surface 66 to downwardly bias the latching end 52 and cause the floating latch 4 to pivot about the pivot ends 70. The pivoting of the floating latch 4 may cause the mating end 51 to rise away from the header connector subassembly 3 (shown in FIG. 1) and disengage from the protrusion 42 (shown in FIG. 3) of the header connector subassembly 3. The plug connector subassembly 2 may then be removed from the header connector subassembly 3.

Figure 7:
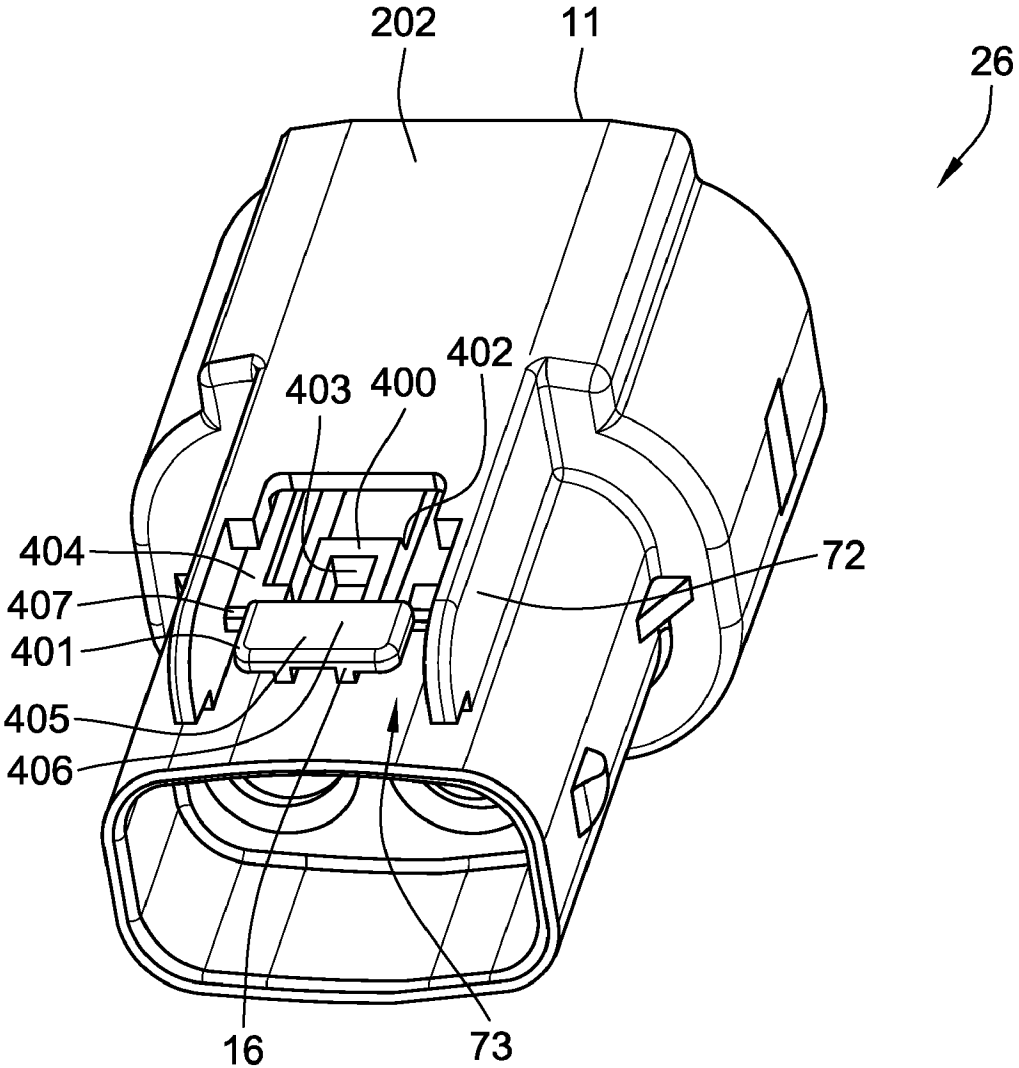
FIG. 7 is a perspective view of a plug outer housing shown in FIG. 1 in accordance with one embodiment of the present disclosure.

FIG. 7 is a perspective view of the plug outer housing 26 in accordance with one embodiment of the present disclosure. As shown in FIG. 7, the flexible latch 401 longitudinally extends from the top 202 of the plug outer housing 26. The flexible latch 401 may be positioned within the latch cover 72 and extend into the opening 73. The flexible latch 401 may be coupled to the plug outer housing 26 such that the flexible latch 401 is fixed in position with respect to the plug outer housing 26 and may not longitudinally or laterally slide relative to the plug outer housing 26. A latching end 16 of the flexible latch 401 extends out of the latch cover 72 through the opening 73. In one embodiment, the flexible latch 401 is joined with the plug outer housing 26 in a location away from the latching, end 16. For example, the flexible latch 401 may be a cantilevered beam that is joined to the plug outer housing 26 and extends outward to the latching end 16. The latching end 16 engages the latching end 52 (shown in FIG. 5) of the floating latch 4 (shown in FIG. 1) to secure the flexible latch 401 and the floating latch 4 with one another.

A thumb actuation pad 405 is disposed at or proximate to the latching end 16 of the flexible latch 401. The thumb actuation pad 405 has a thumb activation surface 406 at the latching end 16 of the flexible latch 401. The flexible latch 401 comprises a locking bump 400 having a ramped surface 402 facing the mating end 11 of the plug outer housing 26 and a locking surface 403. The ramped surface 402 and the locking surface 403 intersect one another in the illustrated embodiment. The plug outer housing 26 includes tracks 404 longitudinally extending along opposite sides of the flexible latch 401. Track stops 407 are formed at the termination end of each track 404.

In one embodiment, the floating latch 4 (shown in FIG. 1) is installed into the plug outer housing 26 through the opening 73 of the latch cover 72. The flexible latch 401 may be deflected to install the floating latch 4. For example, the flexible latch 401 may be biased downward to permit the floating latch 4 to be loaded into the opening 73 above the flexible latch 401. The flexible latch 401 may prevent the floating latch 4 from being removed from the latch cover 72 through the opening 73. For example, the flexible latch 401 may at least partially block the opening 73.

FIGS. 8 through 15 are cross-sectional and partial cutaway views that illustrate the stages of assembly or mating of the connector assembly 1 in accordance with one embodiment of the present disclosure. The floating latch 4 and the flexible latch 401 interact during a mating and unmating latching sequence of the plug connector subassembly 2 and the header connector subassembly 3. The mating/unmating latching sequence includes several stages that represent various positions of and interactions between the plug connector subassembly 2 and the header connector subassembly 3. The latching sequence may provide the proper sequence for mating and unmating high voltage conductors in the plug and header connector subassemblies 2, 3 and the proper lapse time between the mating and unmating to prevent damage to the other system components. For example, the mating of the plug and header connector subassemblies 2, 3 using the latching sequence may keep the interlock circuit open until the conductor terminals 36 (shown in FIG. 3) of the header connector subassembly 3 and the cable terminals 28 (shown in FIG. 4) of the plug connector subassembly 2 are mated and capable of transferring electric current therebetween. The unmating of the plug and header connector subassemblies 2, 3 using the latching sequence in a reverse order may keep the conductor terminals 36 of the header connector subassembly 3 and the cable terminals 28 of the plug connector subassembly 2 are mated for a relatively short period of time after the interlock circuit is opened during the unmating of the plug and header connector subassemblies 2, 3. This delay between the opening of the interlock circuit and the unmating of the conductor terminals 36 and the cable terminals 28 may provide time for capacitive components to discharge built-up electric charge before the conductor terminals 36 are separated from the cable terminals 28.

Figure 8:
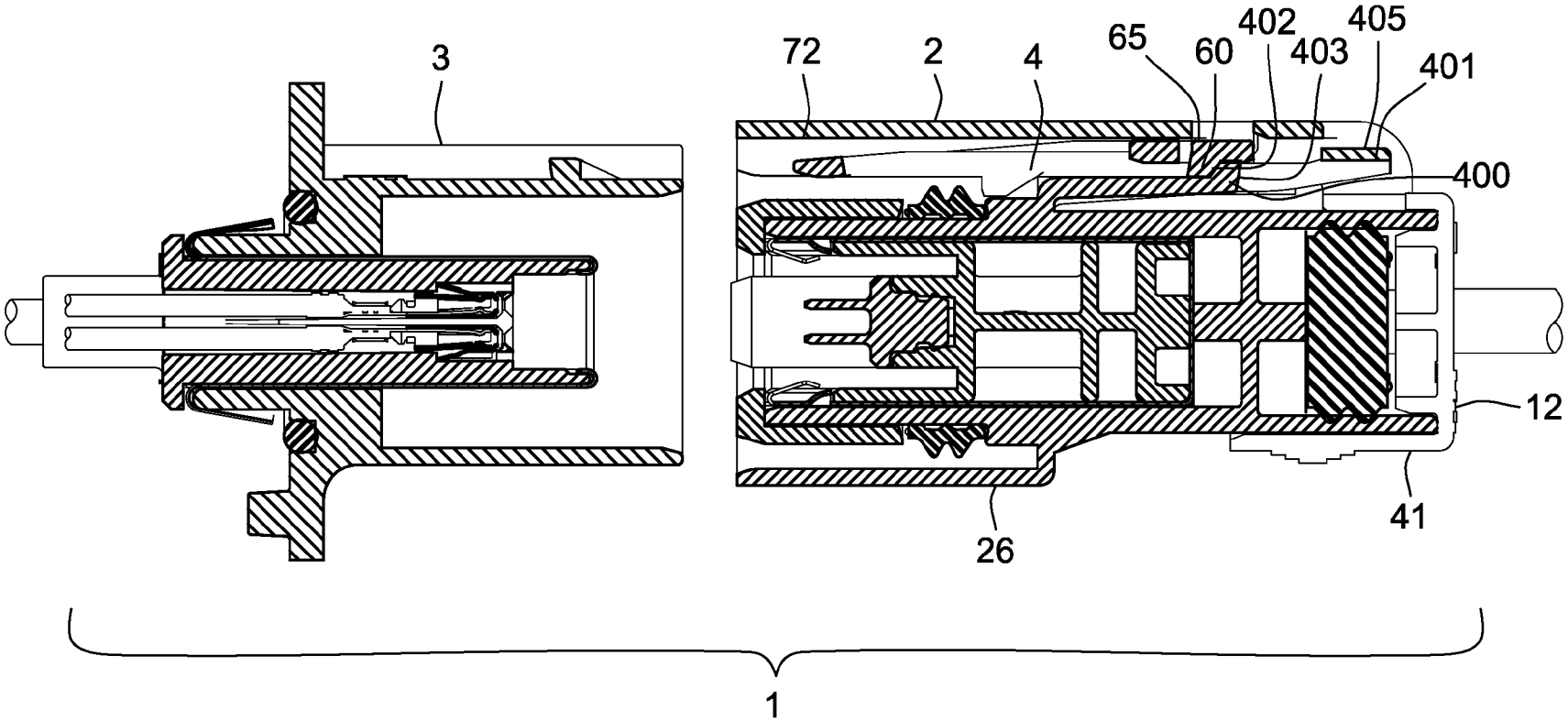
FIG. 8 shows a side cross-sectional view of the unmated connector assembly in accordance with one embodiment of the present disclosure.

FIG. 8 shows a side cross-sectional view of the connector assembly 1 with the plug connector subassembly 2 and the header connector subassembly 3 in the Stage 0 position, or with the plug connector subassembly 2 unmated and disengaged from the header connector subassembly 3. In Stage 0, the cable terminals 28 (shown in FIG. 4) of the plug connector subassembly 2 are unmated with the conductor terminals 36 (shown in FIG. 3) of the header connector subassembly 3. Consequently, the plug connector subassembly 2 is incapable of transferring electric power or current with the header connector subassembly 3 in one embodiment. Also in Stage 0, the shorting bar 23 (shown in FIG. 4) of the plug connector subassembly 2 is unmated with the interlock terminals 18 (shown in FIG. 3) of the header connector subassembly 3. As a result, the interlock circuit in the device or power distribution module to which the header connector subassembly 3 is mounted may remain open. The device or power distribution module does not transfer electric power or current through the cable terminals 28 of the plug connector subassembly 2 and the conductor terminals 36 of the header connector subassembly 3 when the interlock circuit is open.

Prior to and in Stage 0, the floating latch 4 is installed into the plug connector subassembly 2 and the flexible latch 401 is deflected so that the floating latch 4 is installed within the latch cover 72 of the plug outer housing 26. The locking tab 60 of the floating latch 4 is locked or otherwise engaged with the ramped surface 402 and the locking surface 403 of the locking bump 400 of the flexible latch 401. The engagement between the locking tab 60 and the locking bump 400 may deflect or otherwise downwardly bias the flexible latch 401. Additionally, the cable seal retainer 41 is installed at the termination end 12 of the plug outer housing 26 so that the latching cover 72 extends over the flexible latch 401. The floating latch 4 is disposed within the plug outer housing 26 and may travel with the plug connector subassembly 2. The tool actuation block 65 of the floating latch 4 is free to operate and is in a functional state. For example, the tool actuation block 65 may be depressed to pivot the floating latch 4 about the pivot ends 70 (shown in FIG. 5). Conversely, the thumb actuation pad 405 of the flexible latch 401 may not be free to operate and may be in a non-functional state. For example, the flexible latch 401 and the thumb actuation pad 405 may be deflected downward by the floating latch 4 and incapable of being deflected further.

Figure 9:
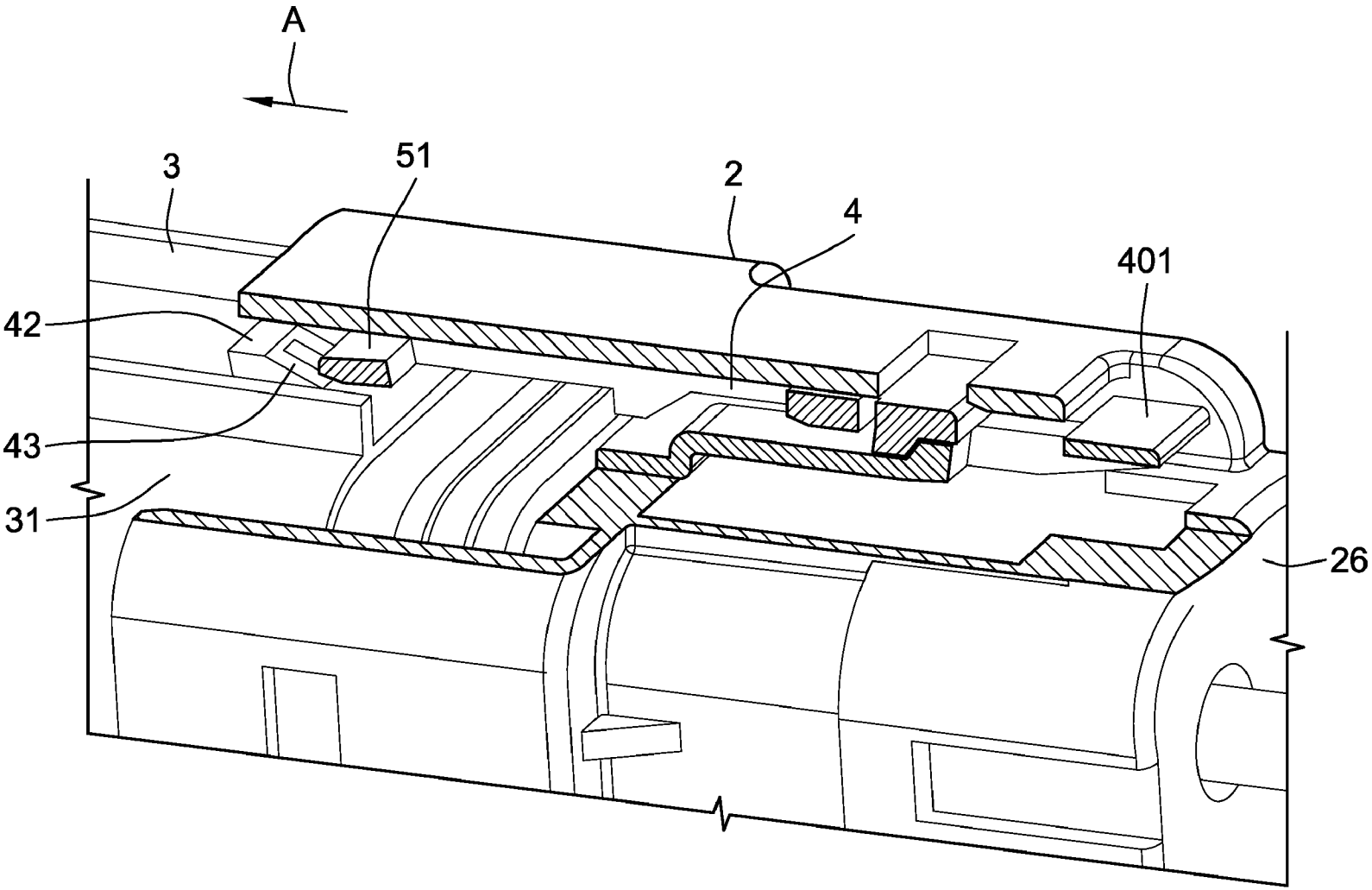
FIG. 9 is a partial cut-away view of the plug connector subassembly and the header connector subassembly as the plug connector subassembly is moved from an unmated position in Stage 0 to a mated position in Stage 1 in accordance with one embodiment of the present disclosure.

FIG. 9 is a partial cut-away view of the plug connector subassembly 2 and the header connector subassembly 3 as the plug connector subassembly 2 is moved from an unmated position in Stage 0 to a mated position in Stage 1. The plug connector subassembly 2 is moved from Stage 0 to Stage 1 by moving the plug connector subassembly 2 along a mating direction A relative to the header connector subassembly 3. The plug connector subassembly 2 is moved in the mating direction A so that the plug outer housing 26 is moved over the header outer housing 31. As the plug connector subassembly 2 is moved to mate with the header subassembly 3, the floating latch 4 travels with the plug connector subassembly 2 and the mating end 51 of the floating latch 4 rides along the ramped surface 43 of the protrusion 42 on the header outer housing 31. As the mating end 51 travels along the protrusion 42, the floating latch 4 and the flexible latch 401 may remain locked or otherwise engaged together. For example, both the floating and flexible latches 4, 401 may be deflected such that neither the tool actuation block 65 (shown in FIG. 5) of the floating latch 4 and the thumb actuation pad 405 (shown in FIG. 7) of the flexible latch 401 are functional. The tool actuation block 65 and the thumb actuation pad 405 may be deflected downward such that neither may be depressed further.

Figure 10:
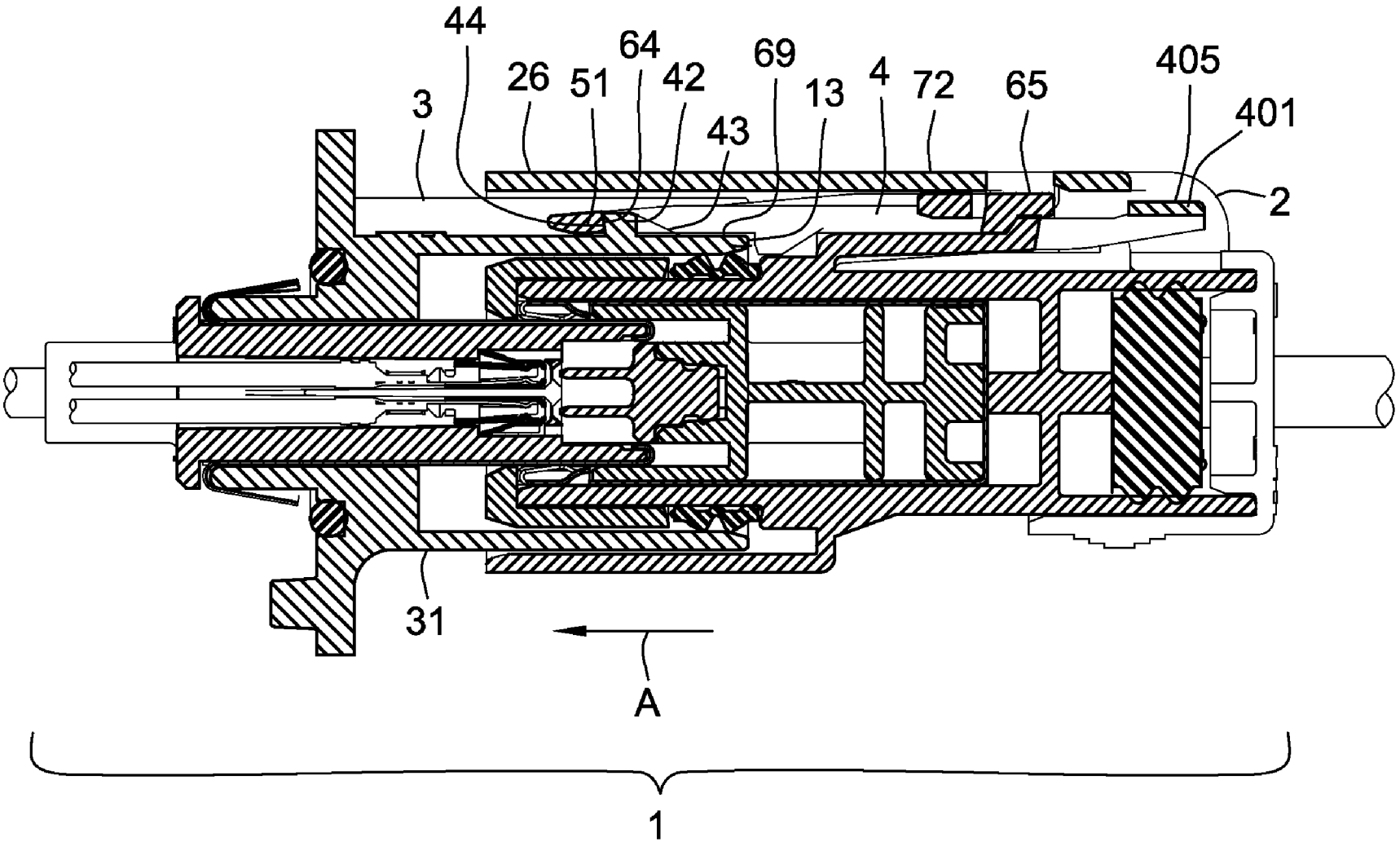
FIG. 10 shows a side cross-sectional view of the connector assembly with the plug connector subassembly and the header connector subassembly in the Stage 1 position in accordance with one embodiment of the present disclosure.
Figure 11:
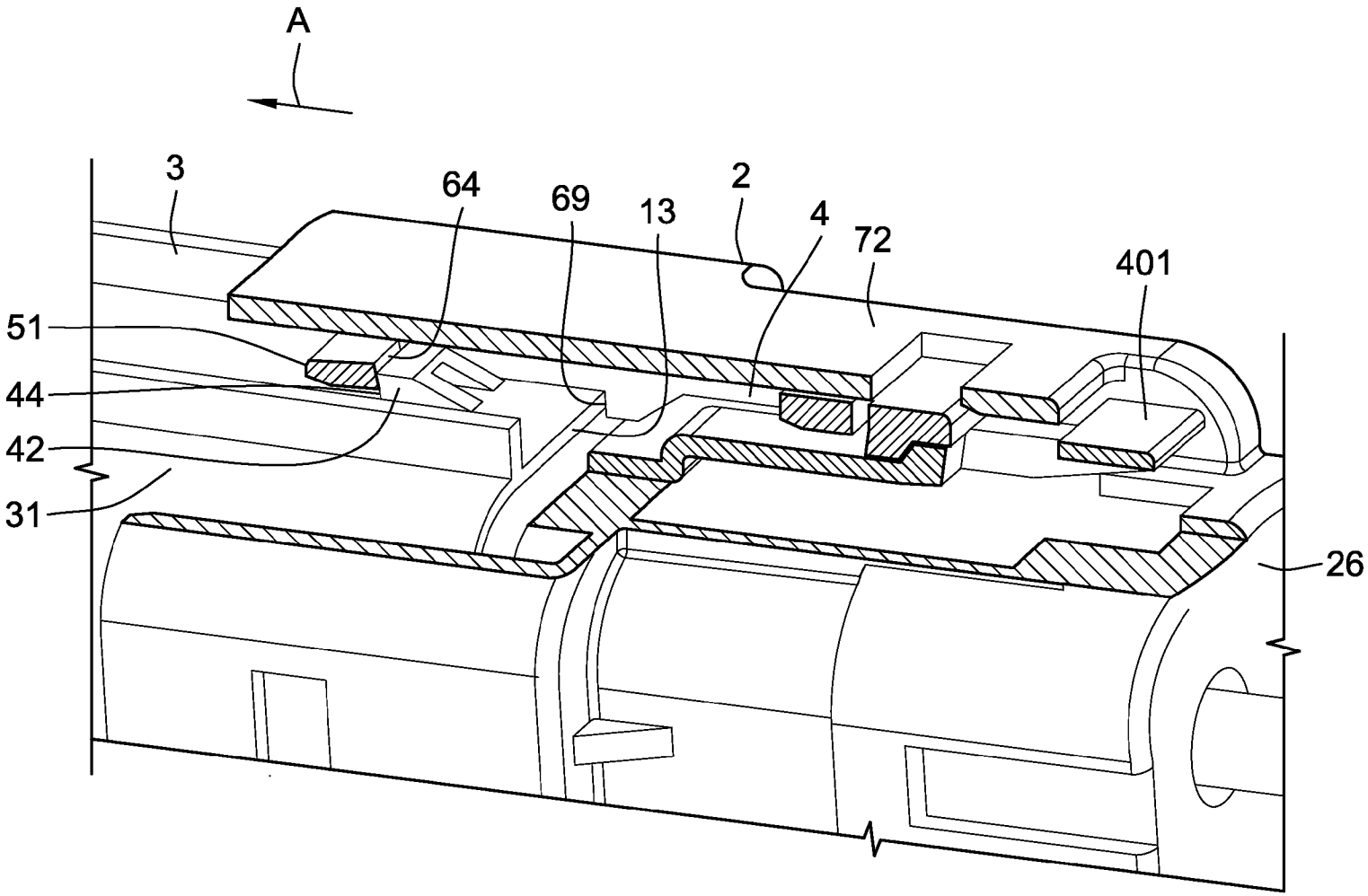
FIG. 11 is a partial cut-away view of the connector assembly in the Stage 1 position in accordance with one embodiment of the present disclosure.

FIG. 10 shows a side cross-sectional view of the connector assembly 1 with the plug connector subassembly 2 and the header connector subassembly 3 in the Stage 1 position. FIG. 11 is a partial cut-away view of the connector assembly 1 in the Stage 1 position. In the Stage 1 position, the floating latch 4 of the plug connector subassembly 2 is engaged and mated with the header connector subassembly 3 but is disengaged from and unmated with the flexible latch 401. In Stage 1, the plug connector subassembly 2 has moved into first locked position over the header connector subassembly 3. For example, the mating end 51 of the floating latch 4 has passed over the ramp surface 43 and latched onto the protrusion 42 of the header connector subassembly 3. The latching surface 64 of the floating latch 4 mates with the stop surface 44 of the protrusion 42 extending from the header outer housing 31. The stop mating surfaces 69 of the floating latch 4 abut the mating end 13 of the header outer housing 31. The engagement between the floating latch 4 and the protrusion 42 locks the floating latch 4 with the header subassembly 3 and prevents the plug connector subassembly 2 from being separated from the header connector subassembly 3 without disengaging the floating latch 4. The engagement between the mating surface 69 and the mating end 13 of the header outer housing 31 prevents the floating latch 4 from being moved further along the mating direction A. For example, the floating latch 4 may travel along the mating direction A with the plug outer housing 26 until the floating latch 4 engages the header connector subassembly 3. After such engagement, continued movement of the plug connector subassembly 2 along the mating direction A may permit the plug outer housing 26 to move along the mating direction A while the floating latch 4 remains substantially stationary. For example, the floating latch 4 may slide relative to the plug outer housing 26 within the latch cover 72.

In Stage 1, the floating latch 4 may no longer be deflected and the tool actuation block 65 may be exposed or otherwise accessible through the opening 73. An operator or user may depress the tool actuation block 65 to cause the floating latch 4 to pivot about the pivot ends 70 (shown in FIG. 5) and raise the mating end 51 of the floating latch 4 above the protrusion 42 to permit the floating latch 4 to disengage and unlatch from the header connector subassembly 3. The flexible latch 401 may continue to be deflected downward by the floating latch 4 such that the thumb actuation pad 405 may not be depressed. For example, in Stage 1, the thumb actuation pad 405 may be non-functional.

Figure 12:
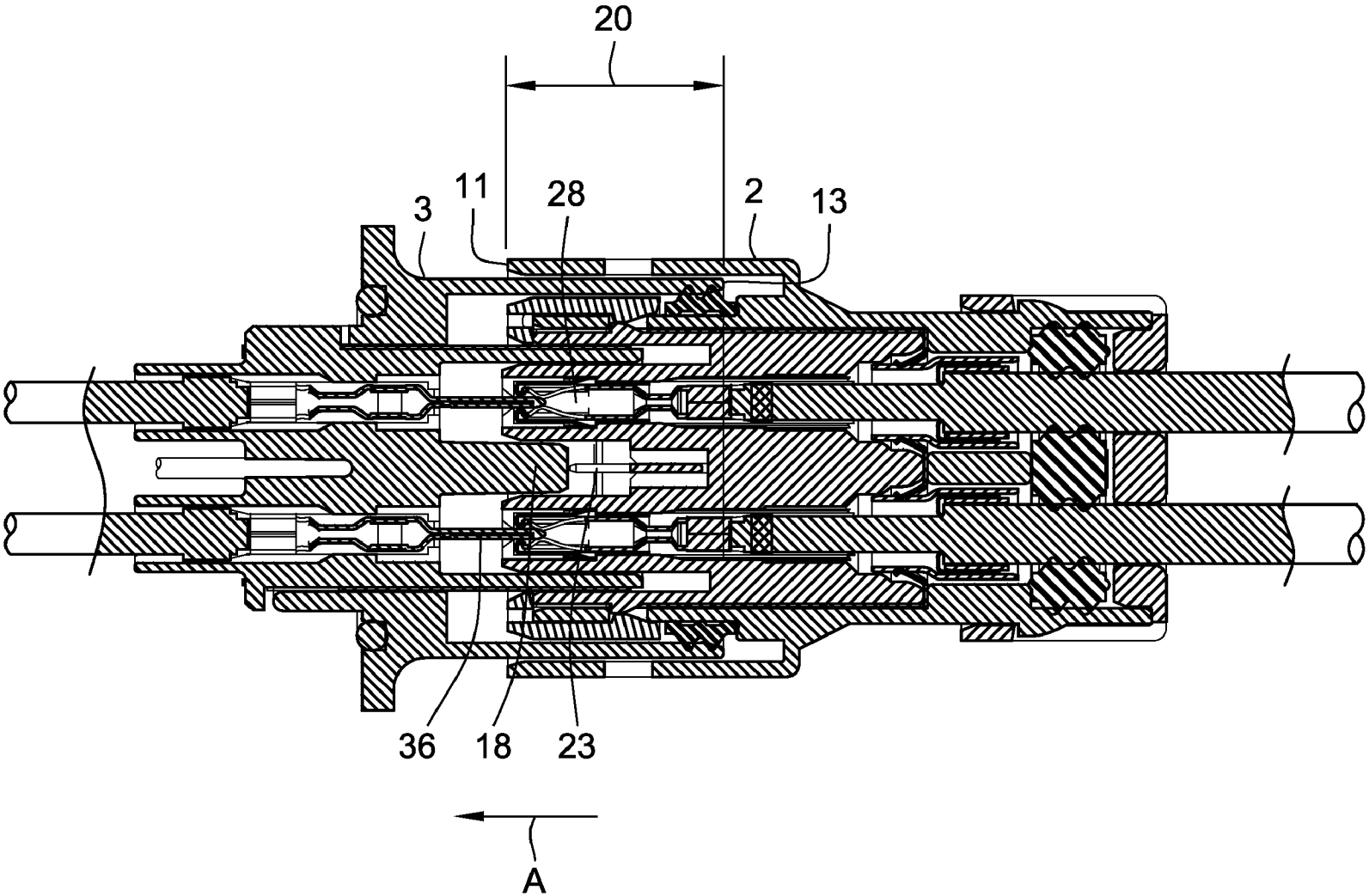
FIG. 12 is a top cross-sectional view of the plug connector subassembly and the header connector subassembly in the Stage 1 position in accordance with one embodiment of the present disclosure.

FIG. 12 is a top cross-sectional view of the plug connector subassembly 2 and the header connector subassembly 3 in the Stage 1 position. The circuit through which electric power or current is transferred between the plug connector subassembly 2 and the header connector subassembly 3 is open in Stage 0 but is closed in Stage 1. For example, prior to Stage 1, the cable terminals 28 of the plug connector subassembly 2 may be unmated with the conductor terminals 36 of the header connector subassembly 3. Consequently, the plug connector subassembly 2 is incapable of transferring electric power or current with the header connector subassembly 3 in one embodiment. In Stage 1, the plug connector subassembly 2 has advanced sufficiently far along the mating direction A relative to the header connector subassembly 3 such that the cable terminals 28 are mated with the conductor terminals 36. For example, the plug connector subassembly 2 may be moved along the mating direction A to a first depth dimension 20 of the header connector subassembly 3. The first depth dimension 20 represents the distance between the mating end 11 of the plug connector subassembly 2 and the mating end 13 of the header connector subassembly 3 along the mating direction A. The first depth dimension 20 may be a predefined threshold distance that the plug outer housing 26 is advanced along the mating direction A in order to mate the cable terminals 28 with the conductor terminals 36.

As a result of the mating of the cable terminals 28 with the conductor terminals 36, the circuit through which electric power or current is supplied between the plug and header connector subassemblies 2, 3 is closed and the power or current may be transferred therebetween. Conversely, the interlock circuit remains open in the Stage 1 position of the plug and header connector subassemblies 2, 3. As shown in FIG. 12, the shorting bar 23 of the plug connector subassembly 2 is unmated with the interlock terminals 18 of the header connector subassembly 3. As described above, the device or power distribution module to which the header connector subassembly 3 is mounted does not transfer electric power or current through the cable terminals 28 of the plug connector subassembly 2 and the conductor terminals 36 of the header connector subassembly 3 when the interlock circuit is open. Therefore, no power or current is transferred between the conductor terminals 36 and the cable terminals 28.

Figure 13:
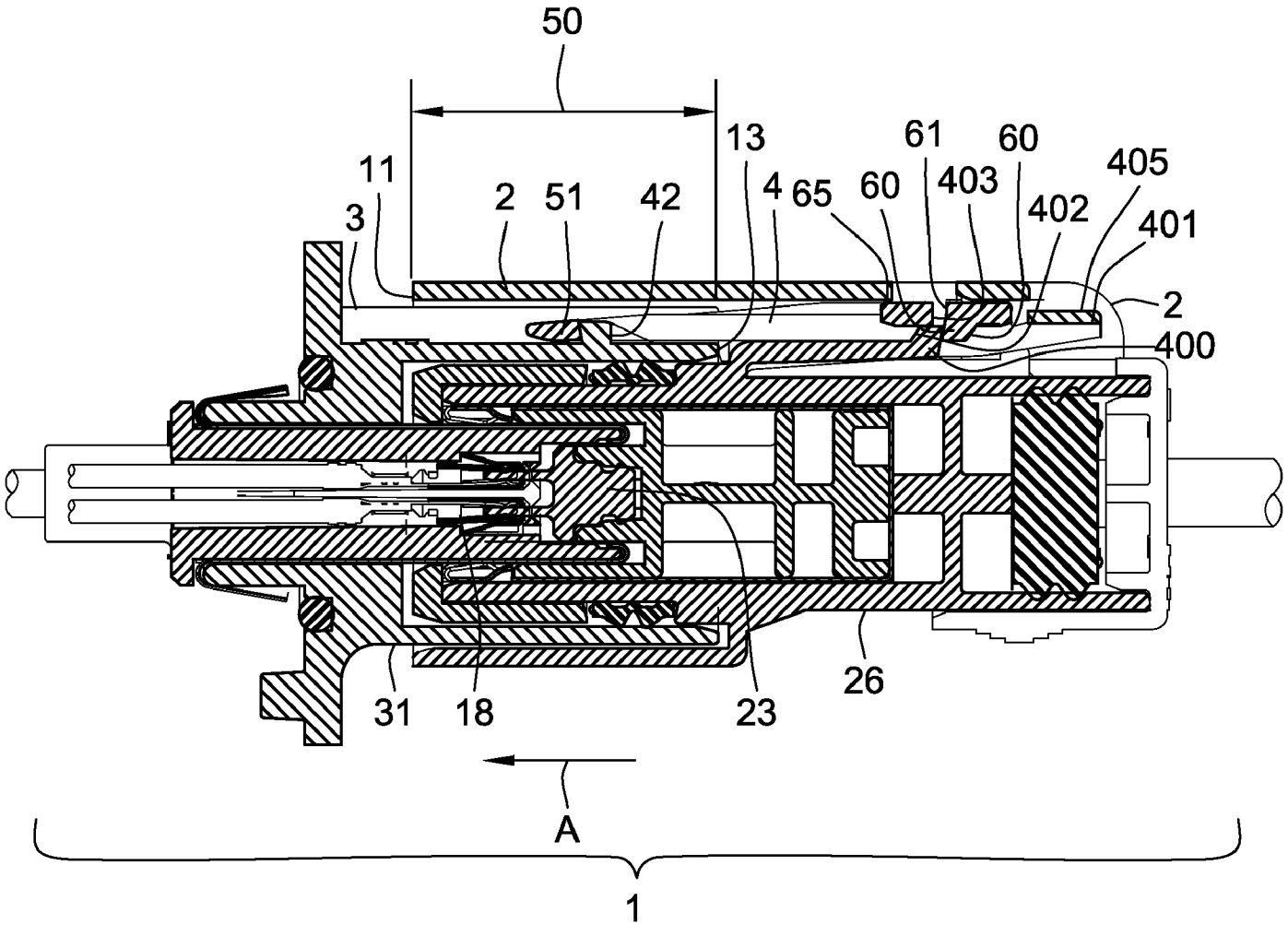
FIG. 13 is a side cross-sectional view of the plug and header connector subassemblies in the Stage 2 position in accordance with one embodiment of the present disclosure.
Figure 14:
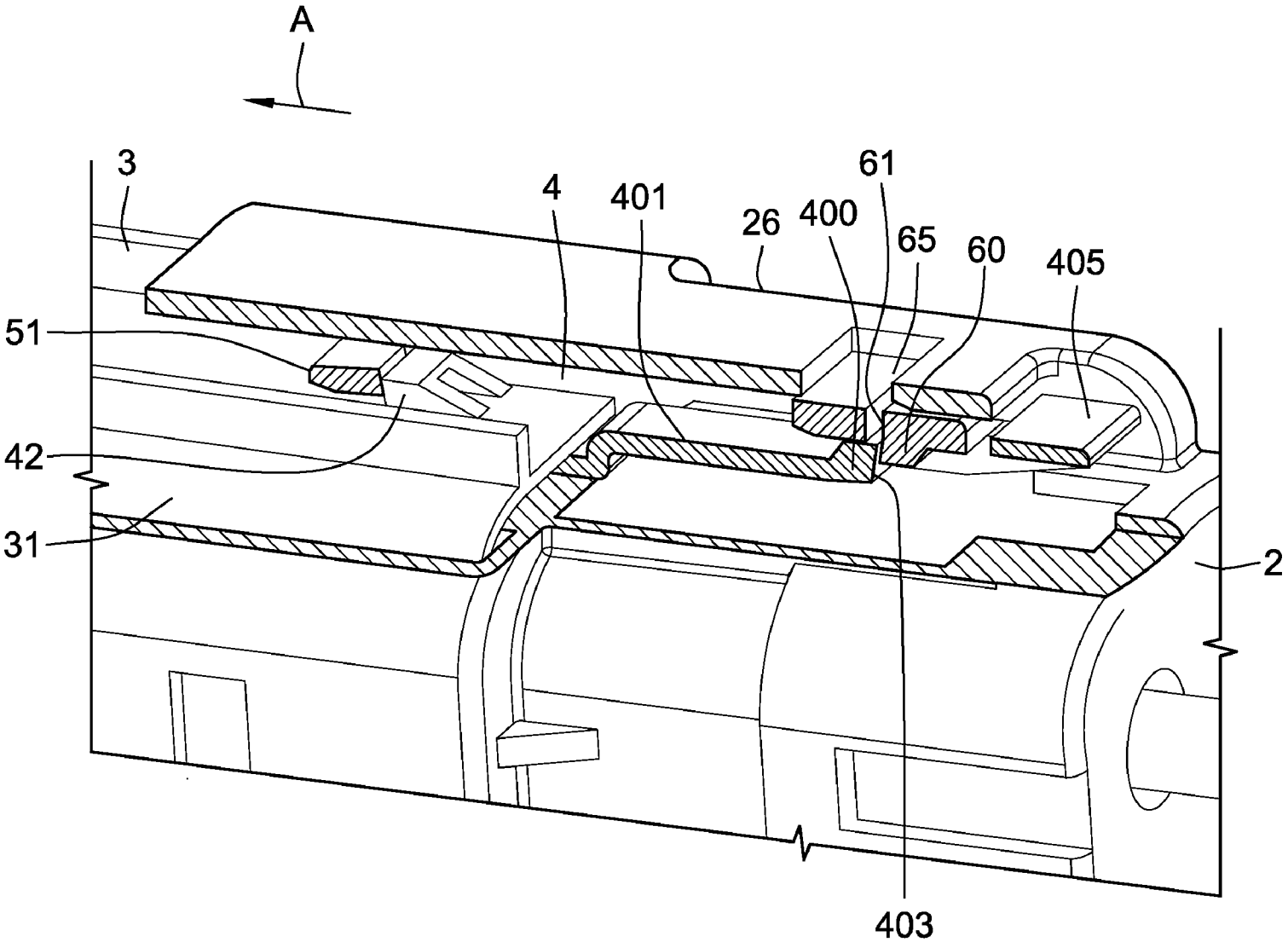
FIG. 14 is a partial cut-away view of the plug and header connector subassemblies in the Stage 2 position in accordance with one embodiment of the present disclosure.

FIG. 13 is a side cross-sectional view of the plug and header connector subassemblies 2, 3 in the Stage 2 position. FIG. 14 is a partial cut-away view of the plug and header connector subassemblies 2, 3 in the Stage 2 position. As the plug and header connector subassemblies 2, 3 move relative to one another along the mating direction A from the Stage 1 position to the Stage 2 position, the plug connector subassembly 2 continues to move in the mating direction A over the header outer housing 31. The floating latch 4 may remain substantially stationary with respect to the header connector subassembly 3 so that the flexible latch 401 moves in relation to the floating latch 4. For example, the engagement between the floating latch 4 and the header connector subassembly 3 may prevent further movement of the floating latch 4 as the plug connector subassembly 2 continues to move in the mating direction A. The floating latch 4 may slide relative to the plug outer housing 26 in a direction that is opposite of the mating direction A as the plug connector subassembly 2 continues to move along the mating direction A.

The flexible latch 401 moves under the floating latch 4 as the plug outer housing 26 moves in the mating direction A until the flexible latch 401 and floating latch 4 mate with one another. In one embodiment, the actuation block 65 of the floating latch 4 remains substantially stationary while the flexible latch 401 moves along the mating direction A until the floating latch 4 rests on the locking surface 403 of the locking bump 400 of the flexible latch 401. For example, the flexible latch 401 may move relative to the floating latch 4 along the mating direction A until the locking surface 61 of the locking tab 60 of the floating latch 4 engages the locking surface 403 of the flexible latch 401. The engagement between the locking tab 60 and the locking surface 403 may secure the floating latch 4 to the flexible latch 401. Additionally, the engagement of the floating latch 4 to both the header connector subassembly 3 and the flexible latch 401 of the plug connector subassembly 2 may secure the plug and header connector subassemblies 2, 3 in a mated relationship.

The floating latch 4 and the track stops 407 of the outer housing 26 may engage one another in such a manner as to prevent inadvertent disengagement of the floating and flexible latches 4, 401 from one another. The rails 57 of the floating latch 4 may rest upon the track stops 407 of the outer housing 26 and be prevented from being depressed by the track stops 407. As a result, the actuation block 65 is in a non-functional state. For example, the actuation block 65 may be prevented from being depressed to pivot the floating latch 4 and disengage the mating end 51 of the floating latch 4 from the protrusion 42 of the header connector subassembly 3. Conversely, the thumb actuation pad 405 of the flexible latch 401 may be functional in Stage 2. For example, an operator or user may depress the thumb actuation pad 405 to lower the flexible latch 401 away from the locking tab 60 of the floating latch 4 to disengage the locking tab 60 from the locking surface 403 of the flexible latch 401.

In Stage 2, the plug connector subassembly 2 has advanced sufficiently far along the mating direction A relative to the header connector subassembly 3 such that the interlock circuit is closed. The interlock circuit may not be closed until the plug and header connector subassemblies 2, 3 are in the Stage 2 position. For example, the shorting bar 23 of the plug connector subassembly 2 may not mate with the interlock terminals 18 of the header connector subassembly 3 until the plug connector subassembly 2 is in the Stage 2 position. In the Stage 2 position, the plug connector subassembly 2 is at a second depth dimension 50 of the header connector subassembly 3. The second depth dimension 50 represents the distance between the mating end 11 of the plug connector subassembly 2 and the mating end 13 of the header connector subassembly 3 along the mating direction A. The second depth dimension 50 may be a predefined threshold distance that the plug outer housing 26 is advanced along the mating direction A in order to mate the shorting bar 23 with the interlock terminals 18.

Figure 15:
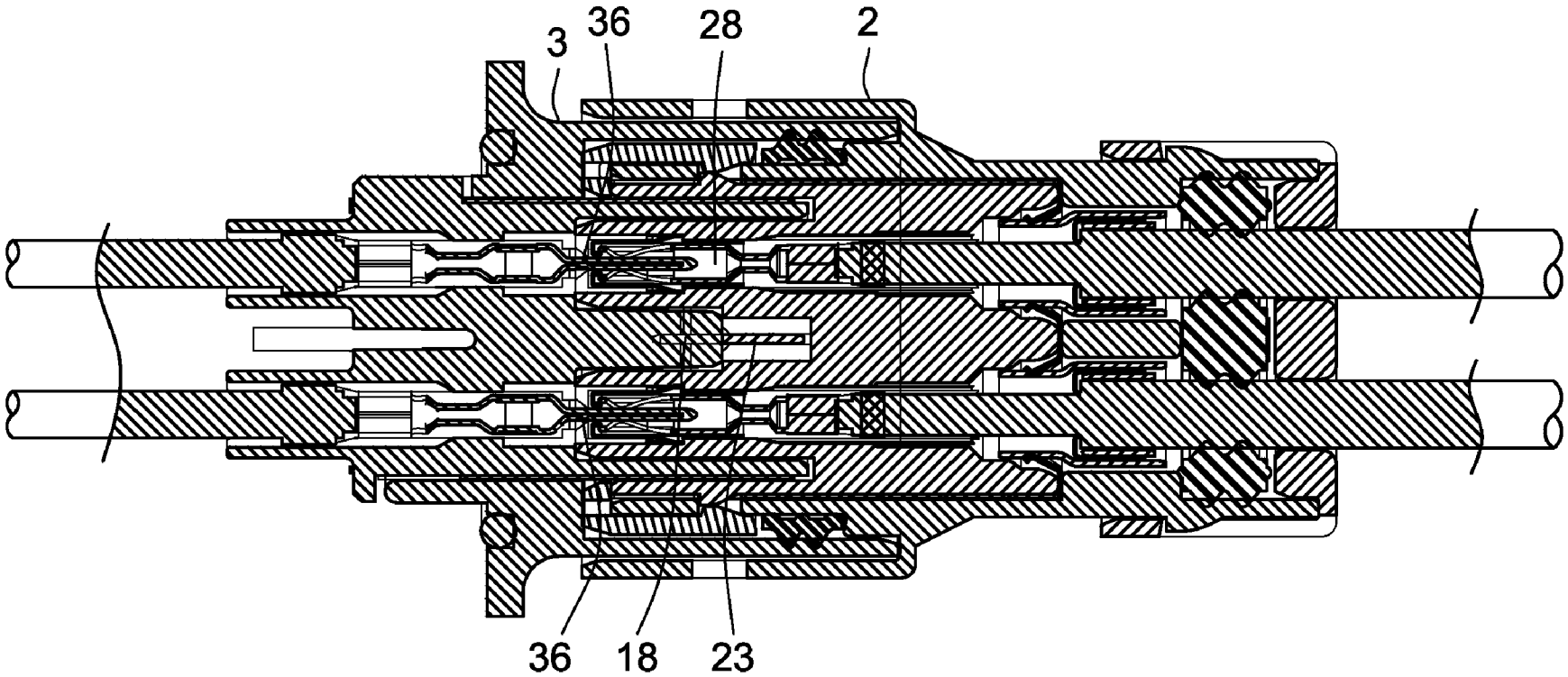
FIG. 15 is a top cross-sectional view of the plug and header connector subassemblies in the Stage 2 position in accordance with one embodiment of the present disclosure.

FIG. 15 is a top cross-sectional view of the plug and header connector subassemblies 2, 3 in the Stage 2 position. In the Stage 2 position, the circuit that transfers electric power or current between the plug and header connector subassemblies 2, 3 is closed and the interlock circuit is closed. With respect to the circuit that transfers electric power or current, for example, the cable terminals 28 of the plug connector subassembly 2 are mated with the conductor terminals 36 of the header connector subassembly 3 at Stage 1 and continue to remain mated with one another as the plug and header connector subassemblies 2, 3 are moved to the Stage 2 position. With respect to the interlock circuit, the shorting bar 23 of the plug connector subassembly 2 remains unmated with the interlock terminals 18 of the header connector subassembly 3 until the plug and header connector subassemblies 2, 3 are in the Stage 2 position. In an embodiment where the device or power distribution module does not transfer power through the conductor terminals 36 and the cable terminals 28 until the interlock circuit is closed, the plug, and header connector subassemblies 2, 3 mate in the latching sequence shown in FIGS. 8 through 15 to mate the conductor terminals 36 and cable terminals 28 prior to mating the shorting bar 23 with the interlock terminals 18.

To unmate or disengage the plug and header connector assemblies 2, 3 from one another, the thumb actuation pad 405 of the flexible latch 401 and the tool actuation block 65 of the floating latch 4 are actuated in reverse order. For example, the thumb actuation pad 405 is depressed to disengage the floating latch 4 from the flexible latch 401, as described above. The plug and header connector subassemblies 2, 3 may then be moved from the Stage 2 position, where the circuit that transfers electric power or current therebetween and the interlock circuit are closed, to the Stage 1 position, wherein the interlock circuit is open but the circuit that transfers power or current remains closed.

Once the floating latch 4 is disengaged from the flexible latch 401, a tool may be used to depress the tool actuation block 65 and cause the floating latch 4 to pivot about the pivot ends 70 (shown in FIG. 5). As described above, the pivoting of the floating latch 4 may raise the mating end 51 of the floating latch 4 out of engagement with the protrusion 42 of the header connector subassembly 3. The plug and header connector subassemblies 2, 3 may then be separated from one another and moved to the Stage 0 position, where both the circuit that transfers or supplies electric power or current and the interlock circuit are open. The delay between opening the interlock circuit and opening the electric power or current supply circuit may provide time for capacitive elements that are electrically coupled with the connector assembly 1 to discharge built-up electric charge.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §1102, sixth paragraph, unless and until such claim limitations expressly use the phrase "means for" followed by a statement of function void of further structure.

What is claimed is:

1. A connector assembly comprising:

an outer housing extending from a mating end to a termination end and including a flexible latch disposed between the mating end and the termination end, the mating end configured to mate with a header connector subassembly; and a floating latch slidably joined to the outer housing between the flexible latch and the mating end of the outer housing, the floating latch extending between opposite ends configured to latch onto the outer housing and the header connector subassembly, wherein, when the outer housing is moved along a mating direction to mate with the header assembly, the floating latch travels with the outer housing until one of the opposite ends of the floating latch couples to the header connector subassembly and, after the floating latch is coupled to the header connector subassembly, the outer housing continues to travel along the mating direction relative to the floating latch with the floating latch sliding relative to the outer housing until another one of the opposite ends couples with the flexible latch of the outer housing.

2. The connector assembly of claim 1, wherein the floating latch is slidably coupled to the outer housing such that the floating latch longitudinally slides relative to the outer housing along the mating direction during mating of the plug outer housing with the header connector subassembly.

3. The connector assembly of claim 1, wherein the floating latch and the outer housing move along the mating direction to a first stage where the floating latch engages and latches onto the header connector subassembly, the outer housing continuing to move along the mating direction to a second stage while the floating latch remains stationary, the floating latch engaging and latching onto the outer housing at the second stage.

4. The connector assembly of claim 1, wherein the outer housing is received into the header connector assembly to a first depth dimension when the floating latch engages the header connector subassembly and the outer housing is received into the header connector subassembly to a greater second depth when the floating latch engages the outer housing.

5. The connector assembly of claim 4, wherein the floating latch moves relative to the outer housing as the outer housing moves from the first depth dimension to the second depth dimension.

6. The connector assembly of claim 1, further comprising a cable terminal and a conductive shorting bar disposed in the outer housing, wherein the cable terminal mates with a conductor terminal of the header connector subassembly when the floating latch engages the header connector subassembly and the shorting bar mates with an interlock terminal of the header connector subassembly when the floating latch engages the outer housing.

7. The connector assembly of claim 6, wherein the floating latch secures the cable terminal and the conductor terminal in a mated relationship prior to securing the shorting bar and the interlock terminal in a mated relationship.

8. The connector assembly of claim 1, further comprising a cable terminal and a shorting bar disposed in the outer housing, the cable terminal configured to mate with a conductor terminal of the header assembly to transfer an electric current therebetween, the shorting bar configured to mate with an interlock terminal of the header assembly to close an interlock circuit that controls transfer of the electric current between the cable terminal and the conductor terminal.

9. The connector assembly of claim 8, wherein the cable terminal mates with the conductor terminal of the header connector subassembly when the floating latch engages the header connector subassembly and the shorting bar mates with the interlock terminal of the header connector subassembly when the floating latch engages the outer housing.

10. The connector assembly of claim 8, wherein the cable terminal mates with the conductor terminal and the floating latch engages the header connector subassembly prior to the shorting bar mating with the interlock terminal and the floating latch engaging the outer housing.

11. A connector assembly comprising:

an outer housing that is configured to mate with a header connector subassembly along a mating direction;

a cable terminal disposed in the outer housing and configured to mate with a conductor terminal of the header connector subassembly to transfer an electric current therebetween;

an shorting bar disposed in the outer housing and configured to mate with a interlock terminal of the header connector subassembly to close an interlock circuit that controls transfer of the electric current; and a floating latch joined to the outer housing and configured to latch onto each of the outer housing and the header connector subassembly to secure the outer housing to the header connector subassembly, wherein the floating latch engages the header connector subassembly to secure the cable terminal with the conductor terminal prior to the floating latch engaging the outer housing to secure the shorting bar with the interlock terminal.

12. The connector assembly of claim 11, wherein the floating latch is slidably joined to the outer housing such that the floating latch slides relative to the outer housing along the mating direction.

13. The connector assembly of claim 11, wherein the floating latch moves with respect to the header connector subassembly until the floating latch engages the header connector subassembly and the floating latch moves with respect to the outer housing until the floating latch engages the outer housing when the outer housing mates with the header connector subassembly.

14. The connector assembly of claim 11, wherein the floating latch and the outer housing move along the mating direction to a first stage where the floating latch engages and latches onto the header connector subassembly, the outer housing continuing to move along the mating direction to a second stage while the floating latch remains stationary, the floating latch engaging the outer housing at the second stage.

15. The connector assembly of claim 11, further comprising a flexible latch coupled to the outer housing and disposed rearward of the floating latch, wherein the floating latch engages the flexible latch to secure the outer housing to the header connector subassembly.

16. The connector assembly of claim 11, wherein the outer housing is received into the header connector subassembly to an initial depth when the floating latch engages the header connector subassembly and the outer housing is received into the header connector subassembly to a greater final depth when the floating latch engages the outer housing.

17. The connector assembly of claim 11, wherein the floating latch includes opposite ends that each engage a different one of the header connector subassembly and the outer housing.

18. The connector assembly of claim 17, wherein, when the outer housing is moved along the mating direction to mate with the header connector subassembly, the floating latch travels with the outer housing until one of the opposite ends of the floating latch couples to the header connector subassembly and, after the floating latch is coupled to the header connector subassembly, the outer housing continues to travel along the mating direction relative to the floating latch with the floating latch sliding relative to the outer housing until another one of the opposite ends couples with the flexible latch of the outer housing.

19. The connector assembly of claim 17, wherein the floating latch is pivotally coupled to the outer housing to permit the end of the floating latch that is coupled with the header connector subassembly to raise and disengage from the header connector subassembly.

20. The connector assembly of claim 11, wherein the floating latch disengages the outer housing to unmate the shorting bar from the interlock terminal prior to disengaging the header connector subassembly to unmate the voltage terminal from the conductor terminal when the outer housing is removed from the header connector subassembly.

* * * * *